US006206143B1

(12) United States Patent
Kammura

(10) Patent No.: US 6,206,143 B1
(45) Date of Patent: Mar. 27, 2001

(54) ELEVATOR LANDING APPARATUS

(75) Inventor: Kosei Kammura, Tokyo (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/389,746

(22) Filed: Sep. 7, 1999

(30) Foreign Application Priority Data

Sep. 7, 1998 (JP) ..... 10-252680
Feb. 24, 1999 (JP) ..... 11-046391

(51) Int. Cl.[7] ..... B66B 7/00
(52) U.S. Cl. ..... 187/400; 187/394; 187/291
(58) Field of Search ..... 187/400, 394, 187/291, 318

(56) References Cited

U.S. PATENT DOCUMENTS 4,019,606 * 4/1977 Caputo et al. ..... 187/394
4,683,990 * 8/1987 Wright ..... 187/394
4,750,592 * 6/1988 Watt ..... 187/394
5,135,081 * 8/1992 Watt et al. ..... 187/394
5,347,094 * 9/1994 Leone et al. ..... 187/309
5,360,085 * 11/1994 Yoo et al. ..... 187/394 X
5,509,505 * 4/1996 Steger et al. ..... 187/394
6,006,866 * 12/1999 Horne et al. ..... 187/316
6,050,369 * 4/2000 Leone et al. ..... 187/392

FOREIGN PATENT DOCUMENTS 64-6110 2/1989 (JP) .

* cited by examiner

*Primary Examiner*—Douglas Hess
*Assistant Examiner*—Thuy U. Tran
(74) *Attorney, Agent, or Firm*—Oblon, Spivak, McClelland, Maier & Neustadt, P.C.

(57) ABSTRACT

An elevator landing apparatus including a detector mounted on one of a doorsill part of a cage of an elevator provided in an elevator shaft and a doorsill part of an elevator hall, and a detected member mounted on the other of the doorsill part of the elevator hall and the doorsill part of the cage. The detector and detected member are configured to position the cage at a position where the doorsill part of the elevator hall and the doorsill part of the cage are flush with each other when the detector and the detected member are opposite each other. The one of the detector or the detected member provided on the doorsill part of the cage is mounted along a side of the cage and facing toward a side of the elevator shaft. The other of the detected member or detector provided on the doorsill part of the elevator hall is mounted extending from the doorsill part of the elevator hall to be opposite the one of the detector or detected member mounted along the side of the cage between the side of the elevator shaft and the one of the detector or detected member mounted along the side of the cage.

6 Claims, 6 Drawing Sheets

ELEVATOR LANDING APPARATUS

CROSS REFERENCE TO RELATED APPLICATION

This application claims benefit of priority to Japanese Patent Application Nos. JP10-252680 filed Sep. 7, 1998, and JP11-046391 filed Feb. 24, 1999, the entire disclosure of which is incorporated by reference herein.

BACKGROUND OF THE INVENTION

1. Field of the Invention

The present invention relates to an elevator including a cage suspended by a cable and configured to move up and down in an elevator shaft of a building, and in particular relates to a landing apparatus for positioning the cage at a position where the doorsill part of the elevator hall is flush with the doorsill part of the cage.

2. Description of the Background

A conventional landing apparatus 91 for an elevator 81 shown in FIGS. 1 and 2 is composed of a detector 92 provided on an upper part of a cage 84, and a detecting plate 94 mounted on a guide rail 83 via an arm 93. The detector 92 is composed of a signal generating part 95 and a signal receiving part 96, facing opposite each other with an interval existing therebetween. The signal generating part 95 generates a signal toward the signal receiving part 96.

The detecting plate 94, which is made of a material to block the signal generated by the signal generating part 95, is provided at the position on the guide rail 83 side to be interposed between the signal generating part 95 and the signal receiving part 96 when the doorsill part of the elevator hall and the doorsill part of the cage 84 become flush with each other.

When the detecting plate 94 is interposed between the signal generating part 95 and the signal receiving part 96 so that the signal generated from the signal generating part 95 is not received by the signal receiving part 96, the landing apparatus 91 stops the cage 84 for positioning the same at the position where the doorsill parts can be flush with each other.

Japanese Patent Application Publication (koukoku) No. 64-6110 discloses another conventional landing apparatus 101 composed of a detector 102 provided in a doorsill part 85 of a cage 84 and a detected member 103 provided in a doorsill part 87 of an elevator hall 86. The detector 102 and the detected member 103 are provided such that they face opposite each other when the cage 84 is placed at a position where the doorsill parts 85, 87 are flush with each other.

The detector 102 is composed of a signal generating part for generating a signal and a signal receiving part for receiving the signal. The detected member 103 a reflector which reflects the signal generated from the signal generating part so as to guide the signal to the signal receiving part.

When the detector 102 and the detected member 103 face with each other, the landing apparatus 101 operates a driving device (not illustrated) so as to stop the cage 84 at the position where the doorsill parts 85, 87 are flush with each other. At this time, a signal generated from the signal generating part is reflected by the detected member 103 so as to be received by the signal receiving part.

The landing apparatus 91 of the elevator 81 shown in FIGS. 1 and 2 requires a slight adjustment of the position along the vertical direction of the detecting plate 94 upon installing the elevator 81 in the elevator shaft in the building for stopping the cage 84 at the position where the doorsill parts are flush with each other.

Moreover, the positions of the detector 92 and the detecting plate 94 need to be adjusted such that the detecting plate 94 can pass between the signal generating part 95 and the signal receiving part 96 without contacting the detector 92 when the cage 84 moves up and down. These adjustments add labor to the installation, as a result of which the installation cost tends to rise.

Furthermore, since the landing apparatus 101 disclosed in Japanese Patent Application Publication (koukoku) No. 64-6110 is provided with the detector 102 and the detected member 103 in a small space defined by the doorsill part 85 of the cage 84 and the doorsill part 87 of the elevator hall 86, respectively, a signal generated from the signal generating part of the detector 102 can be reflected by the wall surface of the elevator shaft or an apron attached on the elevator hall 86.

Therefore, due to a malfunction caused by the signal receiving part receiving a signal reflected by the wall surface of the elevator shaft or the apron, sometimes the cage 84 cannot be positioned at the predetermined position.

SUMMARY OF THE INVENTION

An object of the present invention is to provide a novel elevator landing apparatus, capable of installation with reduced labor so as to lower the installation cost, and capable of preventing malfunction so as to reliably position the cage at a position where the doorsill parts of the elevator hall and the cage are flush with each other.

This and other objects are achieved according to the present invention by providing an elevator landing apparatus including a detector mounted on one of a doorsill part of a cage of an elevator provided in an elevator shaft and a doorsill part of an elevator hall, and a detected member mounted on the other of the doorsill part of the elevator hall and the doorsill part of the cage. The detector and detected member are configured to position the cage at a position where the doorsill part of the elevator hall and the doorsill part of the cage are flush with each other when the detector and the detected member are opposite each other. The one of the detector or the detected member provided on the doorsill part of the cage is mounted along a side of the cage and facing toward a side of the elevator shaft. The other of the detected member or detector provided on the doorsill part of the elevator hall is mounted extending from the doorsill part of the elevator hall to be opposite the one of the detector or detected member mounted along the side of the cage between the side of the elevator shaft and the one of the detector or detected member mounted along the side of the cage.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 4:
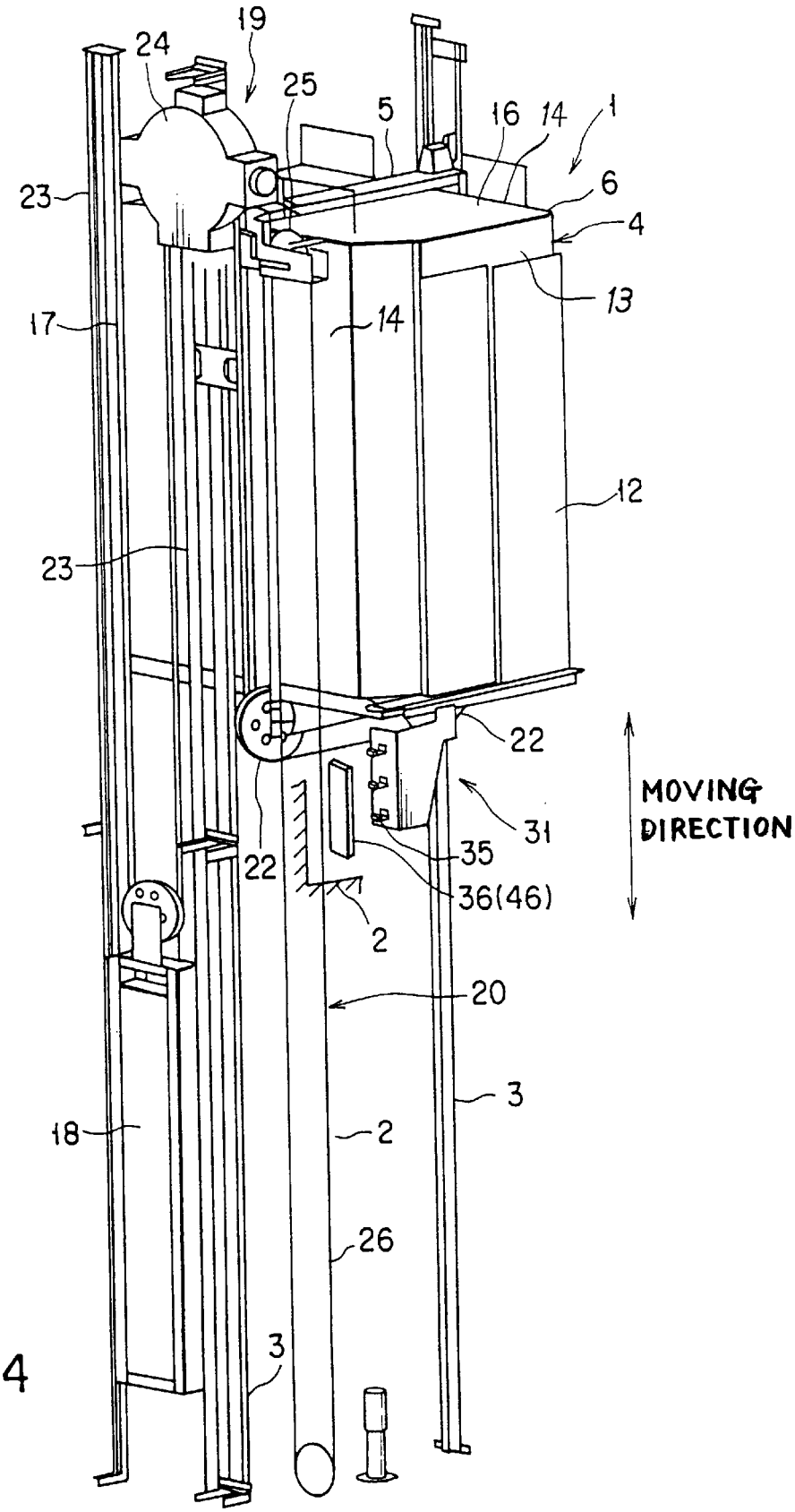
FIG. 4 is a perspective view of an elevator having a landing apparatus of an embodiment of the present invention.

Referring now to the drawings, wherein like reference numerals designate identical or corresponding parts throughout the several views, according to a first embodiment of the present invention shown in FIG. 4. There is provided a landing apparatus 31 of an elevator 1 for stopping a cage 4 of the elevator 1 so as to be positioned at the position where the doorsill part 32 (shown in FIG. 5) of the cage 4 and the doorsill part 34 of an elevator hall 33 (shown in FIG. 5) are flush with each other.

The elevator 1 shown in FIG. 4 is an elevator without a machine room (penthouse), and is realized by installing an elevator control system (control panel) in the vicinity of the elevator hall or in the cage and storing a hoisting device in the uppermost part or the lowermost part of the shaft so as to omit the machine room. In FIG. 4, the hoisting device 24 is placed on and fixed with a hoisting device mounting base, which is fixed with the uppermost part of a guide rail 23.

As shown in FIG. 4, the elevator 1 is composed of a plurality of guide rails 3 provided in an elevator shaft 2 of the building, the cage 4, a cable 17, a counter weight 18, a driving device 19, an emergency stop mechanism 20, and a landing apparatus 31. The guide rails 3 are provided substantially parallel with each other in the elevator shaft 2 of the building along the shaft 2. In the embodiment shown in the FIG. 4, a pair of the guide rails 3 are provided.

The cage 4 is composed of a cage frame 5 and a cab 6 for accommodating passengers. The cage frame 5 is interposed between the guide rails 3, 3, which are parallel with each other.

The cab 6 is composed of a floor 11 (shown in FIG. 5), a front wall 13 having a door 12 facing the elevator hall 33, a pair of side plates 14 connected with right and left end parts of the front wall 13, a back plate for connecting the pair of side plates 14 which are disposed parallel with the front wall 13, and a ceiling plate 16. The cage 4 supports rotatable car sheaves 22, 22 on the lower side thereof. The cable 17 is placed around the car sheaves 22, 22.

One end of the cable 17, made of a metal or the like, is attached to the upper end part of either one of the pair of the guide rails 3, 3, and the other end is attached to the upper end part of either one of counter weight guide rails 23, 23, later described. The cable 17 is placed around the car sheaves 22, 22 so as to suspend the cage 4 in the elevator shaft 2 of the building movably along the guide rails 3, 3.

The counter weight 18 is provided movably along the pair of the counter weight guide rails 23, 23, which are provided along the guide rails 3, 3, and is suspended by the cable 17. The counter weight 18 balances the cage 4 via the cable 17 when a certain number of passengers enter on the cab 6 of the cage 4.

The driving device 19 is composed of a traction sheave (not illustrated) wound around by the cable 17, and the hoisting device 24 for rotating the traction sheave. The driving device 19 functions such that the cage 4 can ascend or descend along the guide rails 3, 3 via the cable 17 by the hoisting device 24 rotating the traction sheave.

The emergency stop mechanism 20 is composed of a governor device 25 and a speed governor cable 26 connected to the cage 4. The emergency stop mechanism 20 is provided for immediately stopping the cage 4 automatically by restraining the speed governor cable 26 when the cage 4 descends faster than a rated speed.

Figure 5:
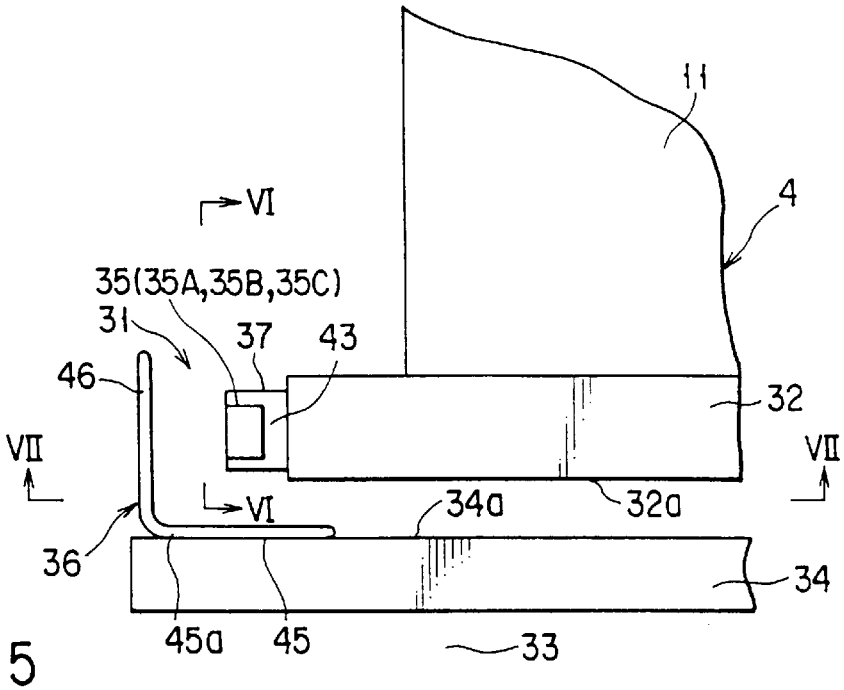
FIG. 5 is a plan view showing the configuration of the landing apparatus of the embodiment.

As shown in FIG. 5, the landing apparatus 31 is composed of a detector 35 and a detected member 36. Either one of the detector 35 and the detected member 36 can be provided on the doorsill part 34 of the elevator hall 33, projecting toward the side of the cage 4. The other is provided on the doorsill part 32 of the cage 4 at a corresponding position.

Figure 6:
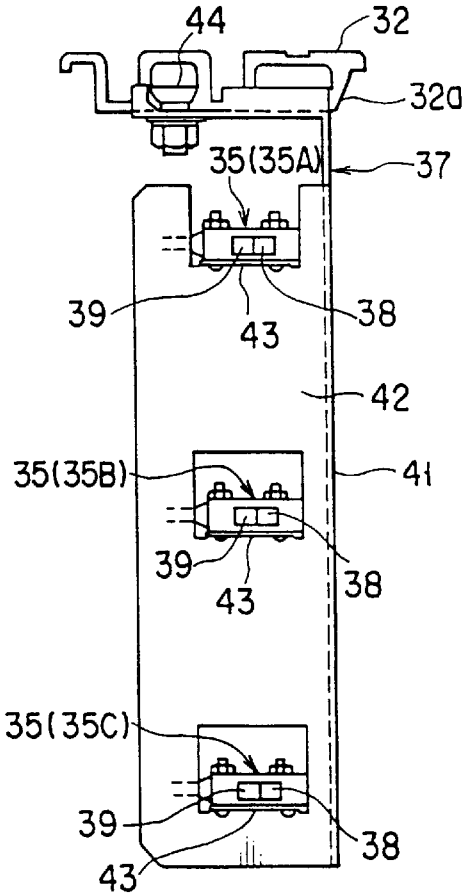
FIG. 6 is a diagram for explanation along the line VI—VI in FIG. 5.
Figure 7:
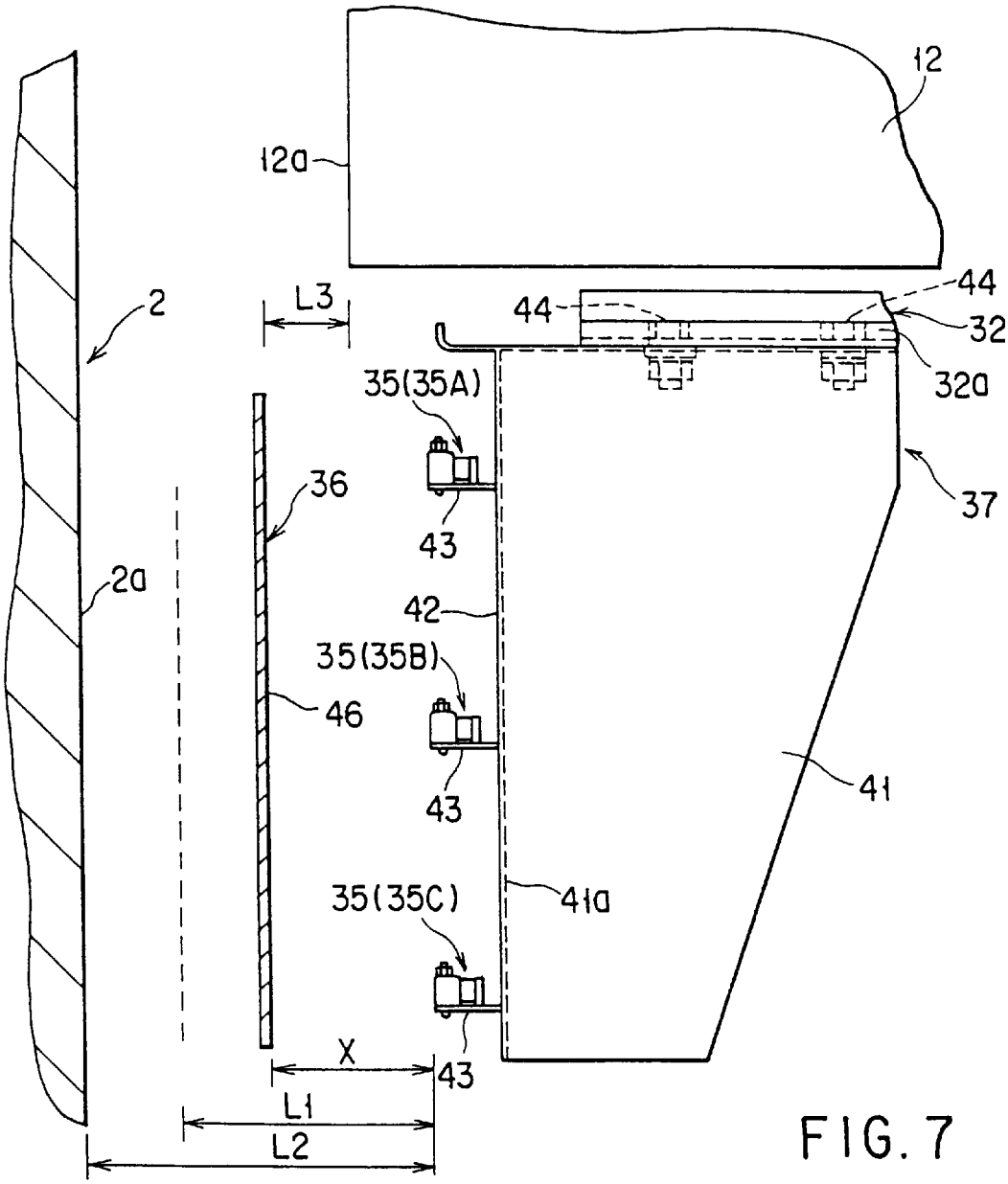
FIG. 7 is a cross-sectional view taken on the line VII—VII in FIG. 5.

In the embodiment shown in the FIG. 5, the detector 35 is mounted on the doorsill part 32 of the cage 4 by means of a mounting flange 37 shown in FIGS. 5 to 7. The detector 35 is provided on the end part of the doorsill part 32 of the cage 4. The detected member 36 is mounted on the doorsill part 34 of the elevator hall 33 on the side of the shaft 2 as shown in FIGS. 5 to 7.

Figure 8:
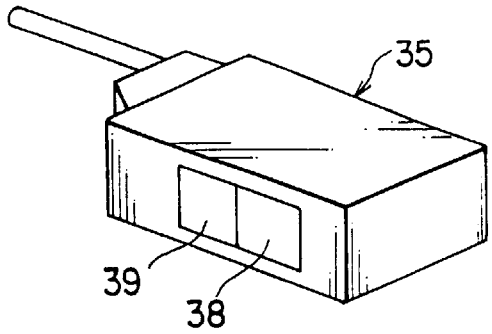
FIG. 8 is a perspective view showing a detector of the embodiment.

As shown in FIGS. 6 and 8, the detector 35 is composed of a light emitting part 38 for emitting a light beam and a light receiving part 39 for receiving the light beam. During operation of the detector 35, a light beam generated from the light emitting part 38 is reflected by an object opposing to the light emitting part 38, such that the reflected light beam is received by the light receiving part 39.

The light receiving part 39 of the detector 35 can receive a light beam reflected by a reflecting part 46, later described, of the detected member 36 spaced apart from the detector 35 by the distance L1 shown in FIG. 7. Furthermore, the detector 35 is configured such that the distance L2 with respect to the wall surface 2*a* of the elevator shaft 2 can be longer than the above-mentioned distance L1.

The detector 35 is supported by the above-mentioned mounting flange 37 such that the direction of a light beam generated by the light emitting part 38 and the direction of a light beam receivable by the light receiving part 39 are disposed along the width direction of the cage 4.

In the embodiment shown in the FIG. 7, three detectors 35 are provided along the vertical direction of the cage 4 (that is, the moving direction of the cage 4). Here the three detectors 35 are referred to as the detectors 35A, 35B 35C from the one closest to the cage 4.

The mounting flange 37 is formed of sheet metal integrally having a mounting part 41 to be mounted on the doorsill part 32 of the cage 4, a supporting part 42 connected with the mounting part 41, and a supporting piece 43 provided on the supporting part 42 for supporting the detector 35.

The mounting part 41 is mounted on the lower surface of the doorsill part 32 with bolts 44. The mounting part 41 is formed along the surface 32*a* of the doorsill part 32 facing the doorsill part 34 of the elevator hall 33, elongating downward from the surface 32*a*. The supporting part 42 is formed from the end part 41*a* at the rim of the cage 4 of the mounting part 41 bent along the side plate 14 of the cage 4.

The supporting piece 43 is formed by bending a notched part of the supporting part 42 in the direction elongating toward the side of the cage 4. The supporting piece 43 supports the detector 35 such that the direction of a light beam generated by the light emitting part 38 and the direction of a light beam received by the light receiving part 39 are along the width direction of the cage 4.

The detected member 36 is formed as a sheet metal integrally having the mounting part 45 and the reflecting part 46. The mounting part 45 is mounted on the surface 34*a* of the doorsill part 34 of the elevator hall 33 facing the doorsill part 32 of the cage 4. The mounting part 45 is formed along the surface 34*a,* elongating downward from the surface 34*a*.

The reflecting part 46 is formed by bending the end part 45*a* of the mounting part 45 on the rim of the doorsill part 34 along the side plate 14 of the cage 4 so as to face with the light emitting part 38 and the light receiving part 39 of the detector 35. The reflecting part 46, configured to reflect and to guide a light beam from the light emitting part 38 of the detector 35 to the light receiving part 39, is composed of a material or a member which can reflect a light beam with a high efficiency, such as a metal plate or plating having a mirror finished surface.

Although the reflecting part 46 is composed of a material or a member which can reflect a light beam with a high efficiency in the reflecting part 46 in the above-mentioned embodiment which utilizes a light beam, if a detector utilizing a beam other than a light beam, such as a sound wave is adopted, a material or a member capable of reflecting a sound wave with a high efficiency is adapted for the reflecting part.

Accordingly, in this embodiment, the detected member 36 is provided on the doorsill part 34 of the elevator hall 33, with the reflecting part 46 projecting toward the side of the cage 4 of the reflecting part 46. Moreover, the detected member 36 is disposed at a position where the distance X between the reflecting part 46 and the detector 35 (shown in FIG. 7) can be shorter than the above-mentioned distance L1. The relationship among the distances L1, L2, and X is represented by formula 1:

$$X<L1<L2 \quad (1)$$

Moreover, the detected member 36 is disposed at a position so as to have a distance L3 between the reflecting part 46 and the door rim 12*a* when the door 12 is opened to its full width. The detected member 36 is disposed at a position so as not to disturb opening or closing of the door 12.

Furthermore, the light emitting part 38 and the light receiving part 39 of the detector 35, and the reflecting part 46 of the detected member 36 are arranged in the state facing opposite each other. The above-mentioned landing apparatus 31 positions the cage 4 utilizing the positional opposition of the detector 35 and the detected member 36 such that the doorsill parts 32, 34 are flush with each other. The light emitting part 38 and the light receiving part 39 of the detector 35, and the reflecting part 46 of the detected member 36 are disposed opposite each other separated by the distance X in the width direction of the cage 4 in the above-mentioned landing apparatus 31.

The operation of the described embodiment is as follows. That is, since the detector 35 and the detected member 36 are mounted on the doorsill parts 32, 34 of the cage 4 and the elevator hall 33, respectively, labor in adjusting the positional relationship between the detector 35 and the detected member 36 along the vertical direction can be reduced during installing the elevator 1. Therefore, increased installation cost of the elevator 1 can be avoided.

In the landing apparatus 31, the detector 35 mounted on the doorsill part 32 of the cage 4 is provided along the side of the cage 4. Therefore, a sufficient distance L2 between the detector 35 and the wall surface 2*a* of the elevator shaft 2 can be ensured, and thus malfunction of the detector 35 can be prevented. Accordingly, the cage 4 can surely be positioned at the position where the doorsill part 34 of the elevator hall 33 and the doorsill part 32 of the cage 4 are flush with each other.

Furthermore, since the wall surface 2*a* of the elevator shaft 2 is disposed outside the detectable range of the detector 35, malfunction can further be surely prevented. Therefore, the cage 4 can further surely be positioned at the position where the doorsill part 34 of the elevator hall 33 and the doorsill part 32 of the cage are flush with each other.

The detected member 36 is disposed at a position so as not to disturb opening or closing of the door 12. Therefore, the door 12 and the detected member 36 cannot be contacted with each other in moving the cage 4 up and down with the door 12 of the cage 4 opened at the time of maintenance work on the elevator 1.

Figure 1:
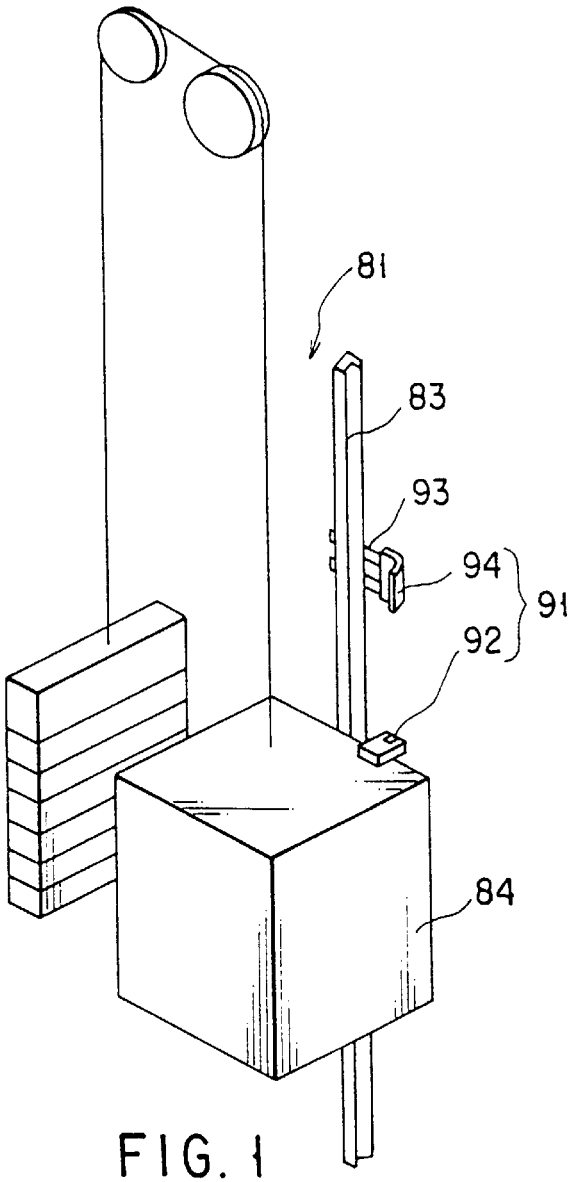
FIG. 1 (PRIOR ART)
FIG. 1 is a perspective view of a conventional elevator.
Figure 2:
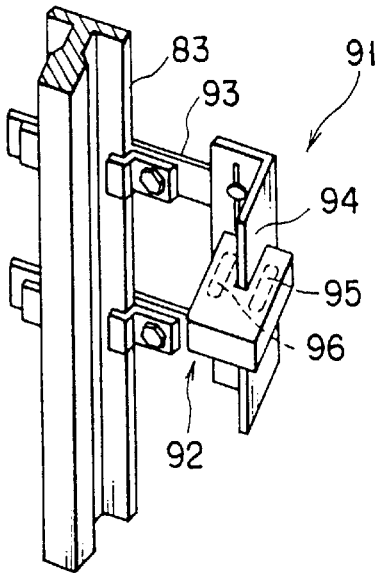
FIG. 2 (PRIOR ART)
FIG. 2 is a perspective view of a landing apparatus of the elevator shown in FIG. 1.
Figure 3:
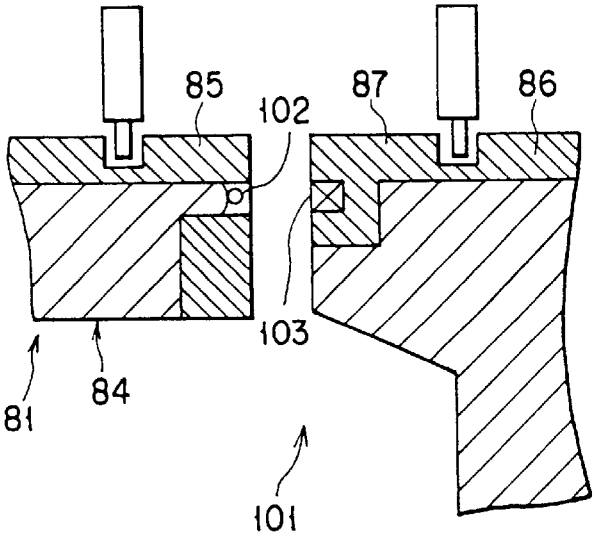
FIG. 3 (PRIOR ART)
FIG. 3 is a cross-sectional view of a landing apparatus of another conventional elevator.

Moreover, since the detector 35 is composed of the light emitting part 38 and the light receiving part 39 configured so that the light receiving part 39 receives a light beam reflected by the reflecting part 46 of the detected member 36, unlike the conventional landing apparatus 91 shown in FIG. 2, adjustment of the positions of the detector 92 and the detecting plate 94 is not required in the installation. Therefore, the installation cost of the elevator 1 can be reduced.

Figure 9:
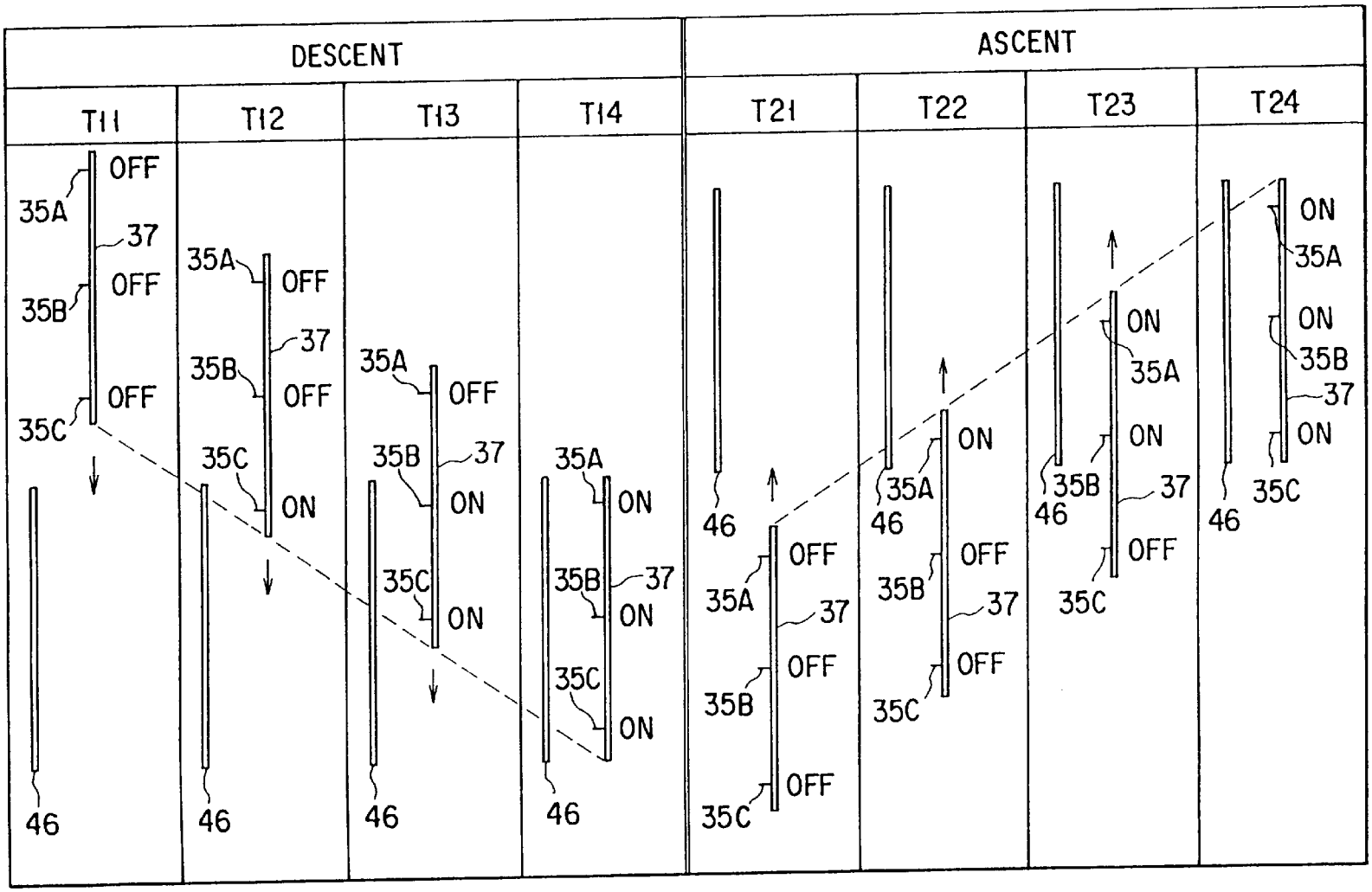
FIG. 9 is a chart showing the function of a landing apparatus having a plurality of landing apparatus.

Moreover, since the detectors 35A, 35B, 35C are provided along the vertical direction of the cage 4 (that is, the moving direction of the cage 4), the following effects can be achieved. That is, as shown in FIG. 9, if all the detectors 35A, 35B, 35C are above the reflecting part 46 and thus none of the detectors 35A, 35B, 35C is on the reflecting part 46 at the time T11, all the detectors 35A, 35B, 35C are off. Then, when the cage 4 descends so that the detector 35C is opposite the reflecting part 46 at the time T12, the detector 35C is turned on whereas the detectors 35A, 35B are off. When the cage 4 further descends so that the detectors 35B, 35C are opposite the reflecting part 46 at the time T13, the detectors 35B, 35C are turned on whereas the detector 35A is off. When the cage 4 further descends so that all the detectors 35A, 35B, 35C are opposite the reflecting part 46 at the time T14, all the detectors 35A, 35B, 35C are turned on.

On the other hand, if all the detectors 35A, 35B, 35C are below the reflecting part 46 and thus none of the detectors 35A, 35B, 35C is on the reflecting part 46 at the time T21, all the detectors 35A, 35B, 35C are off. Then, when the cage 4 ascends so that the detector A is opposite the reflecting part 46 at the time T22, the detector 35A is turned on whereas the detectors 35B, 35C are off. When the cage 4 further ascends so that the detectors 35A, 35B are opposite the reflecting part 46 at the time T23, the detectors 35A, 35B are turned on whereas the detector 35C is off. When the cage 4 further ascends so that all the detectors 35A, 35B, 35C are opposite the reflecting board at the time T24, all the detectors 35A, 35B, 35C are turned on.

Accordingly, when the doorsill part 32 of the cage 4 and the doorsill part 34 of the elevator hall 33 of the building are positioned so as to be flush with each other by the descent of the cage 4, the combinations of on and off of the detectors 35A, 35B, 35C change as shown in T11 to T14. On the other hand, when the doorsill part 32 of the cage 4 and the doorsill part 34 of the elevator hall 33 of the building are positioned so as to be flush with each other by the ascent of the cage 4, the combinations of on and off of the detectors 35A, 35B, 35C change as shown in T21 to T24.

Therefore, by detecting the change of the combinations of on and off of the detectors 35A, 35B, 35C according to time passage, information on the relationship between the descent and ascent of the cage 4, and the positioning operation of the doorsill parts 32, 34 can be provided to, for example, a control system (not shown) for the driving device 19, and the like, and thus it can be utilized for the drive control and safety operation.

Figure 10:
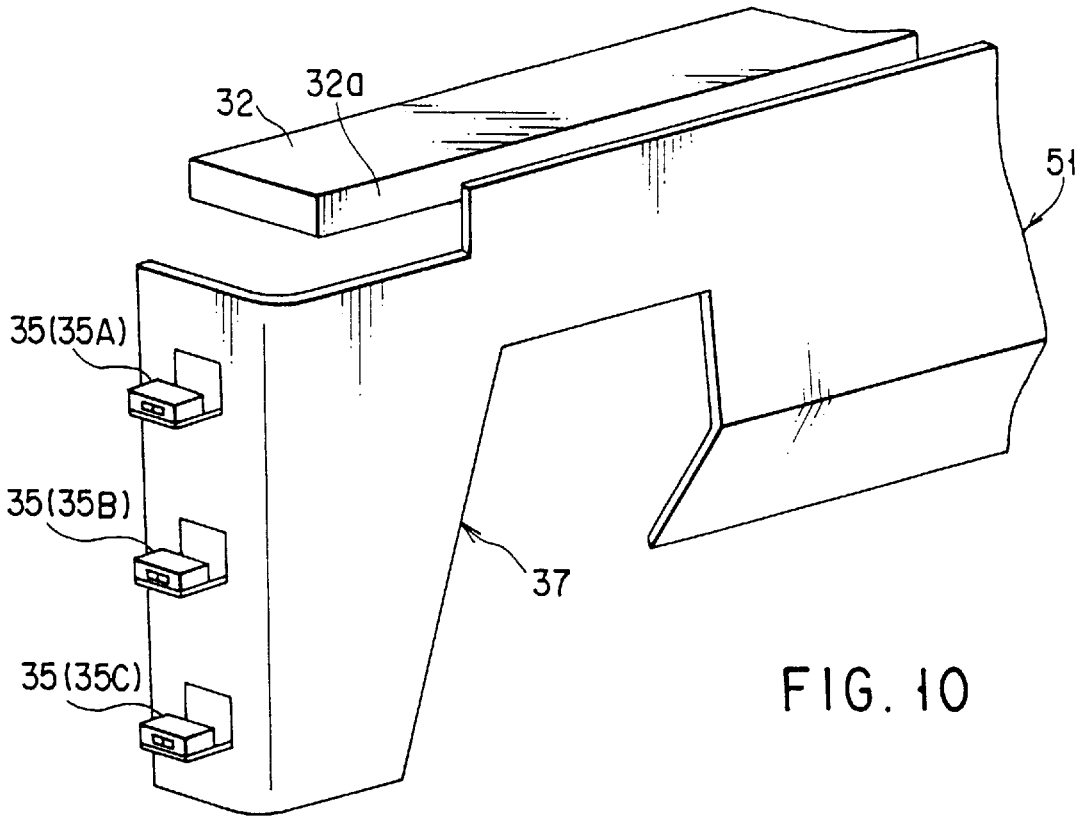
FIG. 10 is a perspective view of a modified embodiment of a mounting flange of the embodiment.
Figure 11:
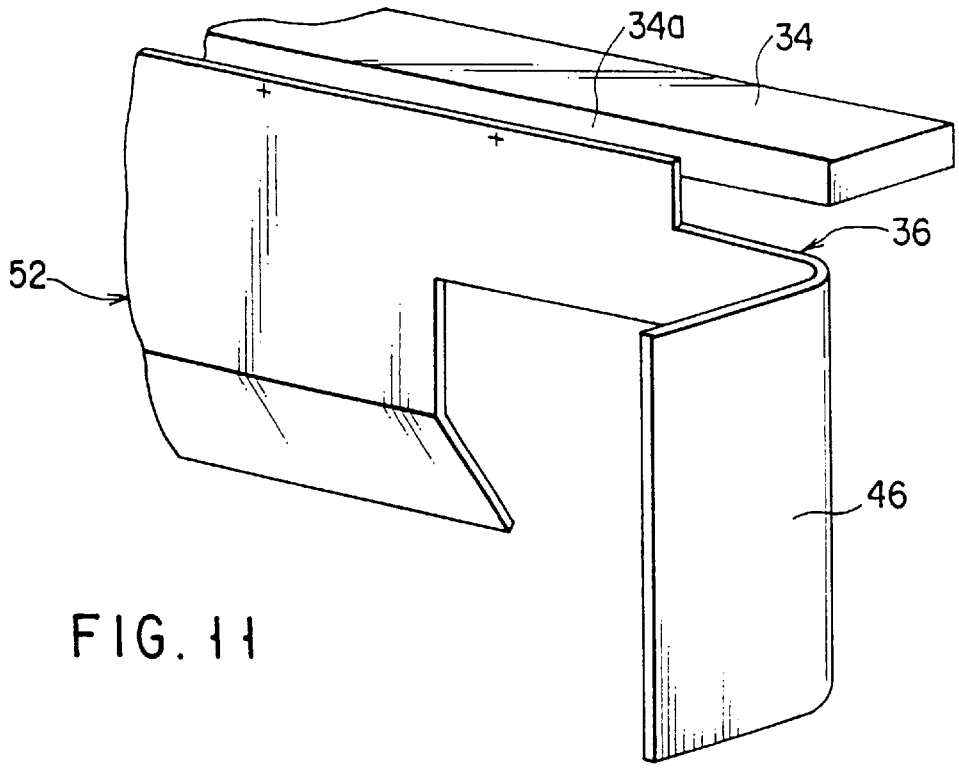
FIG. 11 is a perspective view of a modified embodiment of a reflecting part of a detected member of the embodiment.

Moreover, as shown in FIGS. 10 and 11, aprons 51,52 can be provided as a protecting plate on the doorsill parts 32, 34, respectively for preventing entrance of passenger body parts and entrance of foreign substances into the elevator shaft 2 if the cage 4 stops at a position where the doorsill parts 32, 34 are not flush with each other.

The aprons 51, 52 mounted on the surfaces 32*a*, 34*a* of the doorsill parts 32, 34 facing with each other, are formed like a sheet metal elongating downward from the surfaces 32*a*, 34*a*.

In the above-mentioned embodiment, in installing the aprons 51, 52 on the doorsill parts 32, 34, respectively, the mounting flange 37 can be formed integrally with the apron 51 as shown in FIG. 10, and the reflecting part 46 of the detected member 36 can be formed integrally with the apron 52 as shown in FIG. 11.

In this case, since the mounting flange 37 for mounting the detector 35 and the apron 51 are formed integrally and the reflecting part 46 of the detected member 36 and the apron 52 are formed integrally, the number of parts can be reduced further to reduce cost.

Although the detector 35 is mounted on the doorsill part 32 of the cage 4 and the detected member 36 is mounted on the doorsill part 34 of the elevator hall 33 in this embodiment, the detector 35 can be mounted on the doorsill part 34 of the elevator hall 33 and the detected member 36 can be mounted on the doorsill part 32 of the cage 4 in the present invention.

According to the present invention explained in detail, since the detector and the detected member are provided in opposed relationship on the doorsill part of the cage and the doorsill part of the elevator hall, the installation cost of the elevator can be reduced.

Moreover, since either one of the detector and the detected member, which is mounted on the doorsill part of the elevator hall, is provided projecting toward the side of the cage, the cage can reliably be positioned at the position where the doorsill part of the elevator hall and the doorsill part of the cage are flush with each other.

Numerous variations of the present invention are possible in light of the above teachings. It is therefore to be understood that within the scope of the appended claims, the present invention can be practiced other than as specifically described herein.

What is claimed as new and desired to be secured by Letters Patent of the United States is:

1. An elevator landing apparatus comprising:

a detector mounted on one of a doorsill part of a cage of an elevator provided in an elevator shaft and a doorsill part of an elevator hall; and a detected member mounted on the other of the doorsill part of the elevator hall and the doorsill part of the cage, said detector and detected member configured to position said cage at a position where said doorsill part of the elevator hall and the doorsill part of the cage are flush with each other when the detector and the detected member are opposite each other, the one of the detector or the detected member provided on the doorsill part of the cage being mounted along a side of the cage and facing toward a side of the elevator shaft; and the other of the detected member or detector provided on the doorsill part of the elevator hall mounted extending from the doorsill part of the elevator hall to be opposite the one of the detector or detected member mounted along the side of the cage between the side of the elevator shaft and the one of the detector or detected member mounted along the side of the cage.

2. The elevator landing apparatus as recited in claim 1, wherein:

the cage has a door configured to face the elevator hall, and the other of the detector or the detected member provided on the doorsill part of the elevator hall is disposed at a position so as not to disturb opening or closing of the door.

3. The elevator landing apparatus as recited in claim 1, wherein:

the detector comprises a light emitting part configured to emit a light beam and a light receiving part configured to receive the light beam, and the detected member comprises a reflecting part for reflecting the light beam from the light emitting part to the light receiving part.

4. The elevator landing apparatus as recited in claim 3, wherein:

L1 is a maximum distance between the detector and detected member at which the light receiving part can receive light emitted by the light emitting part and reflected off the detected member, L2 is a distance between the one of the detector or the detected member mounted on the side doorsill part of the cage and a wall surface of the elevator shaft, and X is a distance between the detector and the detected member, and $X<L1<L2$.

5. The elevator landing apparatus as recited in claim 1, further comprising:

an apron provided at the doorsill part of the elevator hall, the other of the detector or the detected member being provided on the doorsill part of the elevator hall being mounted on the apron.

6. The elevator landing apparatus according to claim 1, comprising:

a plurality of detectors mounted on one of the doorsill part of a cage or a doorsill part of an elevator hall and configured to be opposite the detected member when the cage is at the position where said doorsill part of the elevator hall and the doorsill part of the cage are flush with each.

* * * * *

UNITED STATES PATENT AND TRADEMARK OFFICE

CERTIFICATE OF CORRECTION

PATENT NO. : 6,206,143 B1
DATED : March 27, 2001
INVENTOR(S) : Kamimura

It is certified that error appears in the above-identified patent and that said Letters Patent is hereby corrected as shown below:

Title page,
Items [12] and [75], the inventor's name is listed incorrectly. Items [12] and [75] should read as follows:

-- Item [9] United States Patent
Kamimura --

-- Item [75] Inventor: Kosei Kamimura, Tokyo (JP) --

Signed and Sealed this

Sixteenth Day of October, 2001

*Attest:*

Nicholas P. Godici

NICHOLAS P. GODICI
*Acting Director of the United States Patent and Trademark Office*

*Attesting Officer*